US008897474B2

(12) United States Patent
Kim et al.

(10) Patent No.: US 8,897,474 B2
(45) Date of Patent: Nov. 25, 2014

(54) SYNCHRONIZATION SYSTEM AND METHOD FOR TRANSMISSION AND RECEPTION IN AUDIBLE FREQUENCY RANGE-BASED SOUND COMMUNICATION, AND APPARATUS APPLIED THERETO

(75) Inventors: Dong Keon Kim, Seoul (KR); Moon Kee Kim, Yongin-si (KR); Keun Hwan Choi, Seoul (KR); Jae Hwang Yu, Seoul (KR); Min Seok Kim, Seoul (KR); Nam Soo Kim, Seoul (KR); Hwan Sik Yun, Seoul (KR); Ki Ho Cho, Gunpo-si (KR)

(73) Assignees: SK Telecom Co., Ltd., Seoul (KR); SNU R&DB Foundation, Seoul (KR)

( * ) Notice: Subject to any disclaimer, the term of this patent is extended or adjusted under 35 U.S.C. 154(b) by 382 days.

(21) Appl. No.: 13/526,002

(22) Filed: Jun. 18, 2012

(65) Prior Publication Data

US 2012/0269371 A1 Oct. 25, 2012

Related U.S. Application Data

(63) Continuation of application No. PCT/KR2010/004954, filed on Jul. 28, 2010.

(30) Foreign Application Priority Data

Dec. 17, 2009 (KR) ..... 10-2009-0126154

(51) Int. Cl.
*H04R 25/00* (2006.01)
*G10L 19/018* (2013.01)

(52) U.S. Cl.
CPC ..... *G10L 19/018* (2013.01)
USPC ..... 381/320; 381/312

(58) Field of Classification Search
USPC ..... 381/77, 98, 104, 315, 316, 320, 321; 704/270, 273
See application file for complete search history.

(56) References Cited

U.S. PATENT DOCUMENTS 5,822,432 A * 10/1998 Moskowitz et al. ..... 380/28
6,738,744 B2 * 5/2004 Kirovski et al. ..... 704/273

(Continued)

FOREIGN PATENT DOCUMENTS

| | | |
|---|---|---|
| KR | 1020080029446 | 4/2008 |
| KR | 1020090083112 | 8/2009 |
| KR | 1020090108665 | 10/2009 |
| KR | 1020090123718 | 12/2009 |

OTHER PUBLICATIONS

Kiho Cho et al.; "Imperceptible Data Hiding in MCLT Domain for Acoustic Data Transmission Using Loudspeaker and Microphone"; Asia-Pacific Signal and Information Processing Association Annual Summit and Conference; Oct. 2009; pp. 238-241.

(Continued)

*Primary Examiner* — Brian Ensey
(74) *Attorney, Agent, or Firm* — Lowe Hauptman & Ham, LLP

(57) ABSTRACT

Provided is a synchronization system and method for acoustic communication in audible frequency range, and an apparatus applied thereto. The synchronization system for acoustic communication in audible frequency range is configured to prevent deterioration of a synchronization performance and to reduce an amount of calculation by calculating a correlation based on a few samples as opposed to calculating a correlation for each sample when a receiver of the acoustic communication performs synchronization while the acoustic communication is performed in the audible frequency range through modification of an audio signal or adding of a predetermined signal to an audio signal.

8 Claims, 11 Drawing Sheets

(56) References Cited

U.S. PATENT DOCUMENTS

| | | | | |
|---|---|---|---|---|
| 8,169,938 | B2 * | 5/2012 | Duchscher et al. | 381/312 |
| 2002/0107691 | A1 | 8/2002 | Kirovski et al. | |
| 2005/0055214 | A1 | 3/2005 | Kirovski et al. | |

OTHER PUBLICATIONS

Korean Notice of Allowance for 10-2009-0126154 dated Feb. 8, 2012, citing the above reference(s).

International Search Report for PCT/KR2010/004954 dated Feb. 24, 2011, citing the above reference(s).

* cited by examiner

SYNCHRONIZATION SYSTEM AND METHOD FOR TRANSMISSION AND RECEPTION IN AUDIBLE FREQUENCY RANGE-BASED SOUND COMMUNICATION, AND APPARATUS APPLIED THERETO

CROSS REFERENCE TO RELATED APPLICATION

Related Applications

The present application is a continuation of International Application Number PCT/KR2010/004954 filed Jul. 28, 2010, the disclosure of which is hereby incorporated by reference herein in their entirety. Further, this application claims the priority of Korean Patent Application No. 10-2009-0126154, filed on Dec. 17, 2009 in the KIPO (Korean Intellectual Property Office), the disclosure of which are incorporated herein in their entirety by reference.

TECHNICAL FIELD

The present invention relates to acoustic communication, and more particularly, to a synchronization system and method, and an apparatus applied thereto, which may improve a synchronization performance and may reduce an amount of calculation by calculating a correlation value with respect to a few samples instead of each sample when a receiver of the acoustic communication performs synchronization while the acoustic communication is performed in the audible frequency range through modification of an audio signal or adding of a predetermined signal to an audio signal.

BACKGROUND

It has been developed that transforms an audio signal corresponding to a time-domain signal into a frequency-domain signal based on a modified complex lapped transform (MCLT), and that inserts synchronization data by changing a phase of a frequency coefficient.

The synchronization data may be a predetermined value which is shared with a receiver, and may consist of '0' and '1'. In the process of inserting the synchronization data, a phase of a MCLT coefficient may be changed to be '0' or 'π' based on whether the data to be inserted is '0' or '1'.

According to the MCLT, each frame is overlapped half with adjacent ones and interference may occur among frames and thus, phases at a transmitter are changed at a receiver. To enable the phase of the MCLT to be accurately '0' or 'π' at the receiver, a coefficient may be changed by taking into consideration interference among frames at the transmitter.

To perform synchronization, the receiver may transform a received audio signal into a frequency-domain signal based on the MCLT, and may calculate a correlation with predetermined synchronization data. A process of synchronization may calculate an MCLT coefficient for each sample, calculate a correlation from each coefficient, and determine a location where a correlation is greater than a threshold.

However, the receiver may be required to perform a large amount of calculation to calculate the MCLT coefficient for each sample. Although a fast Fourier transform (FFT) may be used to reduce the amount of calculation, this method still requires a large amount of calculation since a coefficient should be calculated for each sample.

Also, a method of calculating an approximate correlation may be utilized to reduce an amount of calculation, but the method has a drawback in that performance of synchronization is deteriorated.

DISCLOSURE

Technical Problem

Therefore, in view of the above-mentioned problems, and an aspect of the present invention is to provide a synchronization system and method for acoustic data communication in audible frequency range, and an apparatus applied thereto, which is used for synchronization in a receiver of the acoustic communication while acoustic communication is performed in the audible frequency range through modification of an audio signal or adding of a predetermined signal to an audio signal.

Another aspect of the present invention is to provide a synchronization system and method for acoustic data communication in audible frequency range, and an apparatus applied thereto, which may prevent deterioration of a synchronization performance and may reduce an amount of calculation by calculating a correlation value based on a few samples instead of each sample.

Technical Solution

In accordance with an aspect of the present invention, there is provided a synchronization system for acoustic data communication in audible frequency range, the system comprising: a transmitter configured to transform an audio signal into a frequency-domain signal based on a first-type transform, to change a phase with respect to a predetermined frequency for inserting synchronization data into the frequency-domain signal, to inverse-transform, based on the first-type transform, the frequency-domain signal to which the synchronization data is inserted into a time-domain signal, and to transmit the time-domain signal; and a receiver configured to transform the time-domain signal received from the transmitter into a frequency-domain signal based on a second-type transform, to normalize a size of coefficient with respect to each frequency to a predetermined size, to inverse-transform, based on the second-type transform, a result of an inner product of the normalized signal and a pre-generated synchronization signal, to overlap the inverse-transformed signal with a previous inversed transformed signal in a predetermined interval, and to determine a location of the synchronization data based on a location of a peak in overlapped signal.

The first transform or the inverse-transform based on the first-type transform may include a modified complex lapped transform (MCLT).

The second-type transform or the inverse-transform based on the second-type transform may include a fast Fourier transform (FFT).

In accordance with an aspect of the present invention, there is provided a receiving apparatus for acoustic data communication in audible frequency range, the apparatus comprising: a transforming unit configured to receive an audio signal, the audio signal being formed by inserting synchronization data into a frequency-domain signal transformed based on a first-type transform and being inverse-transformed, based on the first-type transform, into a time-domain signal, and to transform the audio signal into a frequency-domain signal based on a second-type transform; a normalizing unit configured to normalize, to a predetermined size, a size of coefficient of the frequency-domain signal transformed based on the second-type transform; an inner product calculating unit configured to calculate an inner product of the normalized signal and a pre-generated synchronization signal; an inverse-transforming unit configured to inverse-transform, based on the second-type transform, a result of the inner product; a correlation unit configured to generate a correlation value by overlapping the inverse-transformed signal with a previous inversed transformed signal in a predetermined interval; and a synchronization location detecting unit configured to determine a location of the synchronization data based on a location of a peak in the correlation value.

The first transform or the inverse-transform based on the first-type transform may include a modified complex lapped transform (MCLT).

The second-type transform or the inverse-transform based on the second-type transform may include a fast Fourier transform (FFT)

The transforming unit may be configured to transform an input signal which consists of a frame of audio signal and a predetermined vector.

After transforming the input signal, the transforming unit may be configured to use, as an input signal, an audio signal corresponding to a length of the vector.

The apparatus may further comprise a synchronization signal generating unit configured to generate the synchronization signal.

The synchronization signal generating unit comprises: a first processing module configured to generate the synchronization data to be a first-type signal; a second processing module configured to inverse-transform the first-type signal into a time-domain signal, and to overlap the inverse-transformed first type signal with adjacent inversed transformed signals to the inverse-transformed first type signal in a predetermined interval; and a third processing module configured to generate an input signal by adding a predetermined vector to a result obtained from the second processing module, to transform the input signal into a frequency-domain signal based on the second-type transform, and to provide the transformed input signal to the inner product calculating unit.

In accordance with an aspect of the present invention, there is provided a synchronization method for acoustic data communication in audible frequency range, the method comprising: receiving an audio signal, the audio signal being formed by inserting synchronization data into a frequency-domain signal transformed based on a first-type transform and being inverse-transformed, based on the first-type transform, into a time-domain signal, and transforming the audio signal into a frequency-domain signal based on a second-type transform; normalizing, to a predetermined size, a size of coefficient of the frequency-domain signal transformed based on the second-type transform; calculating an inner product of the normalized signal and a pre-generated synchronization signal; inverse-transforming, based on the second-type transform, a result of the inner product; generating a correlation value by overlapping the inverse-transformed signal with a previous inversed transformed signal in a predetermined interval; and determining a location of the synchronization data based on a location of a peak in the correlation value.

The synchronization method may further comprise generating a synchronization signal.

The step of generating of the synchronization signal may comprise a first processing to generate the synchronization data to be a first-type signal; a second processing to inverse-transform the first-type signal into a time-domain signal, and to overlap the inverse-transformed first type signal with adjacent inversed transformed signals to the inverse-transformed first type signal in a predetermined interval; and a third processing to generate an input signal by adding a predetermined vector to a result obtained from the second processing, to transform the input signal into a frequency-domain signal based on the second-type transform, and to provide the transformed input signal to the inner product calculating unit.

Advantageous Effects

Therefore, in accordance with an aspect of the present invention, deterioration of a synchronization performance can be prevented and an amount of calculation can be reduced by calculating a correlation value based on a few samples as opposed to calculating a correlation value for each sample when a receiver of the acoustic communication performs synchronization while the acoustic communication is performed in the audible frequency range through modification of an audio signal or adding of a predetermined signal to an audio signal.

Accordingly, a drawback in providing an acoustic communication service in an audible frequency range may be overcame.

BRIEF DESCRIPTION OF THE DRAWINGS

The foregoing and other objects, features and advantages of the present invention will become more apparent from the following detailed description when taken in conjunction with the accompanying drawings in which.

BEST MODE

Mode for Invention

Hereinafter, exemplary embodiments of the present invention will be described with reference to the attached drawings.

Figure 1:
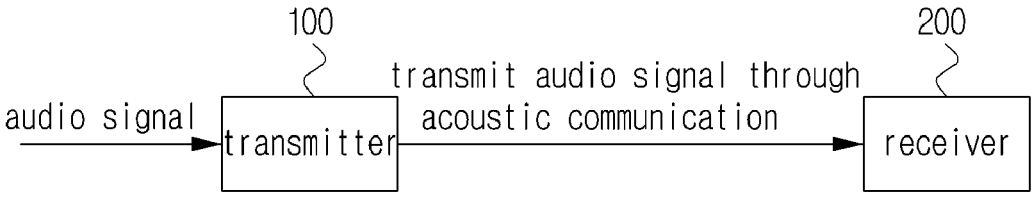
FIG. 1 is a diagram illustrating a configuration of a synchronization system for acoustic communication in audible frequency range according to an embodiment of the present invention.

FIG. 1 illustrates a synchronization system for acoustic communication in audible frequency range according to an embodiment of the present invention.

Referring to FIG. 1, the system may include a transmitter 100 to insert synchronization data into an audio signal by changing a phase, and to transmit the audio signal, and may include a receiver 200 to receive the audio signal transmitted from the transmitter 100 and to determine a synchronization location through a predetermined operation processing including normalization.

The transmitter 100 may insert the synchronization data into the audio signal through a transforming process based on a first-type transform. In particular, the transmitter 100 may transform an audio signal corresponding to a time-domain signal into a frequency-domain signal, may insert synchronization data into the frequency-domain signal by changing a phase of the signal with respect to a predetermined frequency, may inverse-transform the frequency-domain signal to which the synchronization data is inserted into a time-domain signal based on the first-type transform, and may transmit the time-domain signal. Here, the transform or the inverse-transform based on the first-type transform may be used for transforming a audio signal in time-domain into a frequency-domain signal, inserting synchronization data by changing a phase of the frequency-domain signal, and inverse-transforming the frequency-domain signal into a time-domain signal. Hereinafter, the transform or the inverse-transform based on the first-type transform may be a modified complex lapped transform (MCLT).

Figure 2:
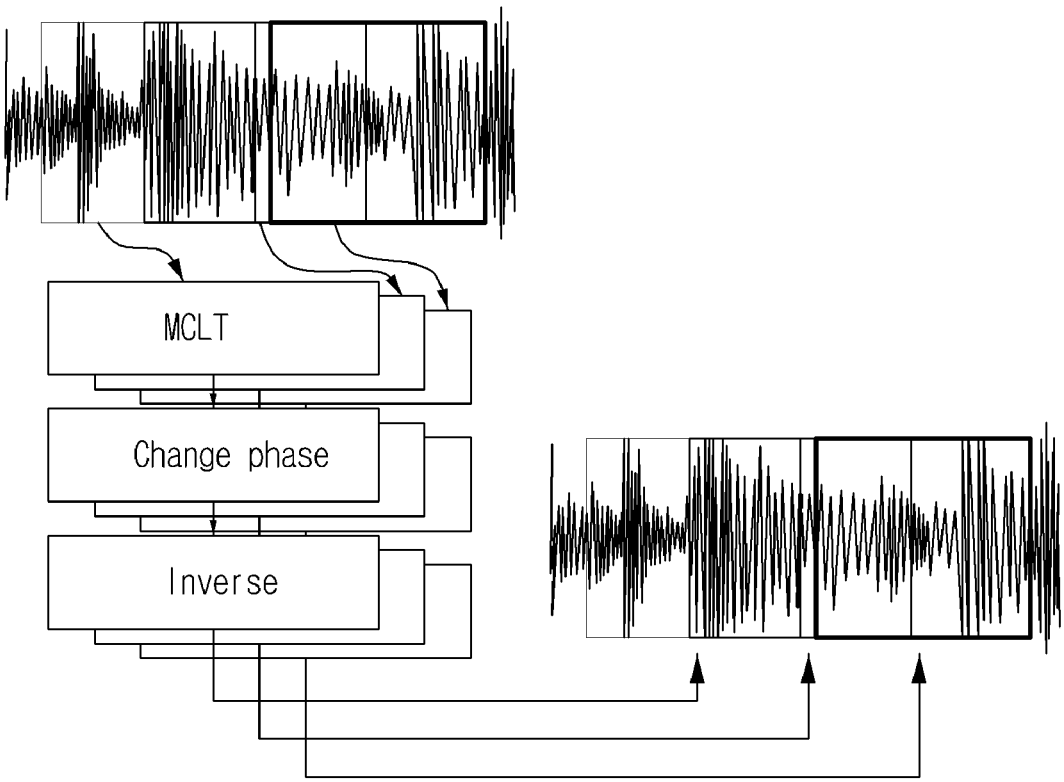
FIG. 2 is a diagram illustrating a process of inserting synchronization data according to an embodiment of the present invention.

That is, as illustrated in FIG. 2, the transmitter 100 may transform an audio signal from a time-domain signal to a frequency-domain signal based on an MCLT, may change a phase of the signal with respect to a predetermined frequency to a form of synchronization data for acoustic communication, may inverse-transform the frequency-domain signal into a time-domain signal based on an inverse-MCLT (IMCLT), and may transmit an audio signal in time-domain to which the synchronization data is inserted, to the receiver 200 through the acoustic communication. Here, the transform based on the MCLT may receive a time-domain signal vector that is a real number and has a length of 2M an input, and may transform the received time-domain signal vector into a frequency-domain signal vector having a length of M. In this example, a value of the frequency-domain signal obtained as a result of the MCLT may be a complex number. The input of the MCLT may be referred to as a frame. Accordingly, data to be used for synchronization may be inserted by changing a value of the frame. When the frequency-domain signal to which the synchronization data is inserted by changing the value of the frame is inverse-transformed based on the IMCLT, a time-domain signal vector having a real number and having a length of 2M may be generated and the time-domain signal vector may be used for the acoustic communication.

In addition, when the transmitter 100 performs a subsequent MCLT, the transmitter 100 may receive, as an input signal, a signal that proceeds by a length of M rather than a length of 2M. Accordingly, after a phase of a predetermined frequency is changed for insertion of synchronization data, the transmitter 100 may perform an operation of overlapping the frame with a rear portion of a previous frame by a length of M, instead of adding a time-axis output signal having a length of 2M.

Figure 3:
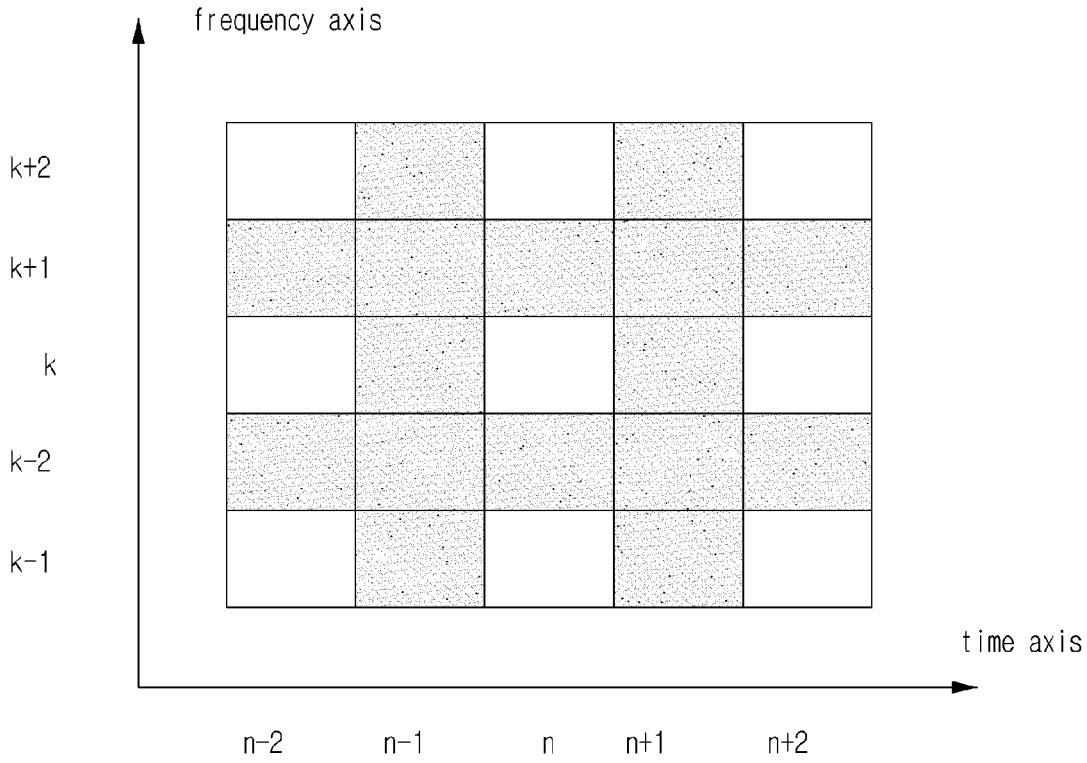
FIG. 3 is a diagram illustrating a process of inserting synchronization data into a modified complex lapped transform (MCLT) coefficient according to an embodiment of the present invention.

For reference, a process of changing a phase of an MCLT coefficient for insertion of synchronization data will be described in detail with reference to FIG. 3. It is assumed that the synchronization data is a vector formed of '0', '1', and a predetermined data is used. To insert synchronization data, a phase of a coefficient output through an MCLT is changed. In this example, a BPSK scheme may be used to change an MCLT coefficient. Accordingly, a phase may be changed to '0' to transmit '0', and may be changed to 'π' to transmit '1'.

In this example, the MCLT may need to consider a relationship between frames overlapping each other by a length of M. In other words, in the MCLT, a value of a coefficient may be changed by being affected by an adjacent coefficient when the frames overlap each other. That is, although a phase of the MCLT coefficient is changed to '0' or 'π' to insert the synchronization data, a phase obtained from a received signal may be changed from the phase changed when the synchronization data is inserted and thus, a synchronization performance may be deteriorated. Therefore, when the synchronization data is inserted, compensation associated with effects among the frames need to be performed with respect to the signal received from the receiver 200 so that a phase of the MCLT coefficient becomes '0' or 'π'.

Accordingly, the transmitter 100 may subtract an effect of an adjacent coefficient in advance to perform compensation associated with the effect among the frames so that the phase of the MCLT coefficient becomes '0' or 'π' More particularly, transmitter 100 may insert synchronization data at alternate frequencies. That is, when the transmitter 100 inserts synchronization data at a frequency index k, insertion may be performed at frequency indices '. . . k−4, k−2, k+2, k+4 . . . ' as illustrated in FIG. 3. Also, the synchronization data may be inserted at alternate frames. That is, when the synchronization data is inserted at a frame index n, insertion may be performed at frame indices '. . . n−4, n−2, n+2, n+4 . . . '. Accordingly, the synchronization data may be inserted into a coefficient corresponding to a white portion illustrated in FIG. 3, and may not be inserted into a coefficient corresponding to a grey portion and thus, a coefficient used for calculating a frame compensation value may have a phase of '0' or 'π'.

The receiver 200 may determine a synchronization point through a process of transforming an audio signal transmitted from the transmitter 100 based on a second-type transform. Particularly, the receiver 200 may transform the audio signal received from the transmitter 100 into a frequency-domain signal through the transform based on the second-type transform, and may normalize a size of each coefficient to a predetermined size. Also, the receiver 200 may inverse-transform, based on the second-type transform, a result of an inner product of the normalized signal and a previously generated synchronization signal, and may perform operation so that an output signal obtained from the inverse-transform based on the second-type transform is overlapped with adjacent ones in a predetermined interval. In addition, the receiver 200 may determine a synchronization point based on a peak value detected from a correlation value corresponding to the result of the operation. Here, the transform or the inverse-transform based on the second-type transform may be used for transforming a audio signal in time-domain into a frequency-domain signal, and inverse-transforming the frequency-domain signal into a time-domain signal after normalizing of a size of a coefficient with respect to a frequency and calculating of an inner product of the normalized signal and a synchronization signal. Hereinafter, the transform or the inverse-transform based on the second-type transform may be referred to as a fast Fourier transform (FFT).

Figure 4:
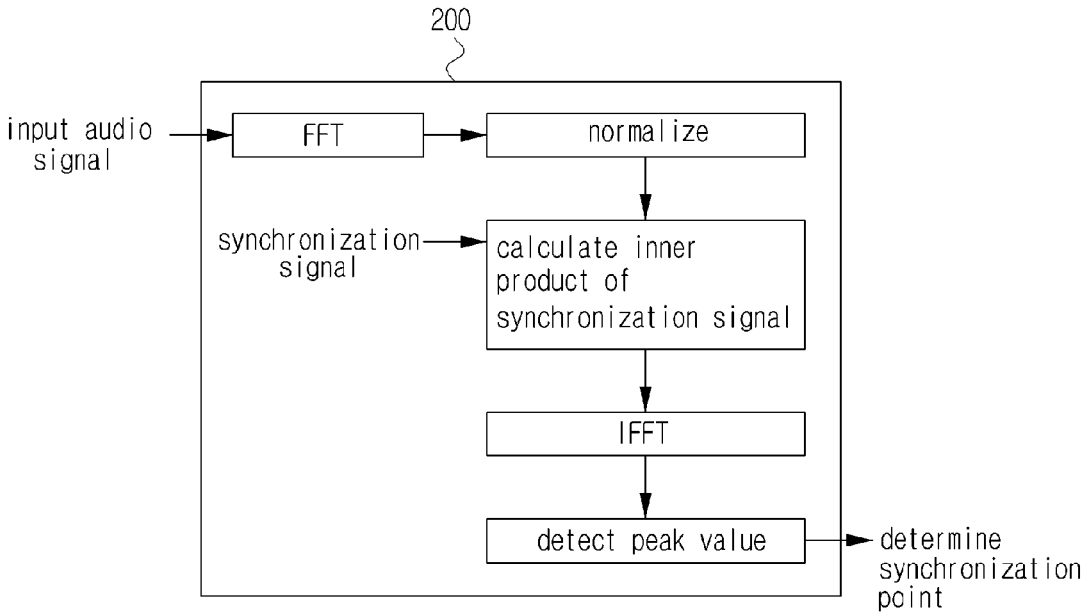
FIG. 4 is a diagram illustrating a synchronization process performed by a receiver according to an embodiment of the present invention.

That is, as illustrated in FIG. 4, for synchronization, the receiver 200 may transform an audio signal received from the transmitter 100 into a frequency-domain signal based on the FFT, may normalize a size of a coefficient, may multiply the normalized signal by a previously generated synchronization signal, and may inverse-transform the multiplied signal into a time-domain signal based on an inverse FFT (IFFT). Subsequently, a synchronization point may be detected from a correlation value obtained by overlapping the signals. In other words, the receiver 200 may transform an audio signal received from the transmitter 100 from a time-domain signal into a frequency-domain signal through use of the FFT. The FFT may be a fast calculation algorithm of a discrete Fourier transform (DFT), and may be used to reduce an amount of calculation. In this example, when a length of a frame of a time-domain signal is 2M in the transmitter 100, the receiver 200 may add '0' vector having a length of 2M to a time-domain signal having the length of 2M, and may use the signal as an input of the FFT. Accordingly, a length of a signal transformed through use of the FFT may be 4M. Subsequently, a signal that proceeds by 2M may be used as an input of the subsequent FFT. In addition, the receiver 200 performs normalization on a size of a coefficient, so that only phase information of a signal can be used in synchronization process (a size information of a signal is not used), which causes excellent performance of synchronization.

Figure 5:
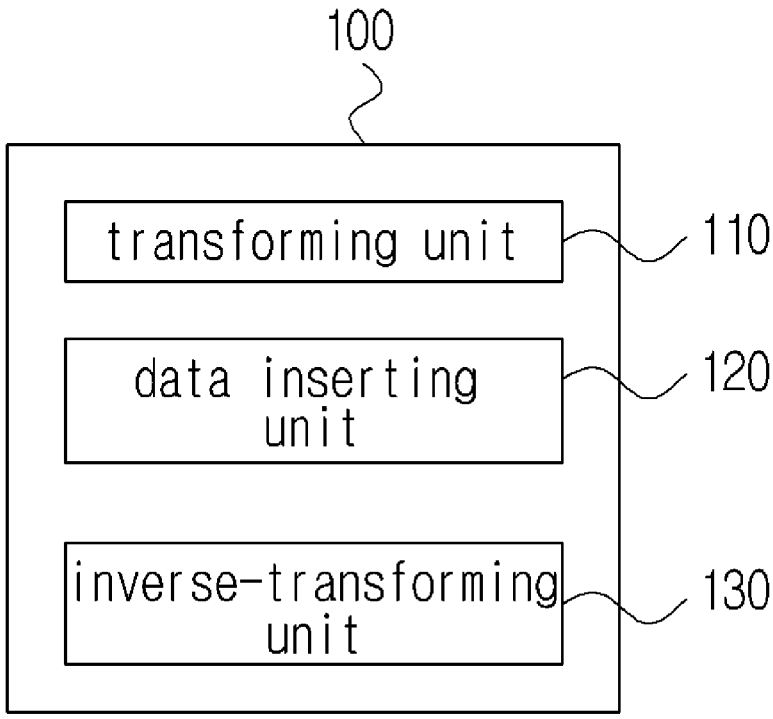
FIG. 5 is a diagram illustrating a configuration of a transmitter according to an embodiment of the present invention.

Hereinafter, the transmitter 100 according to an embodiment of the present invention will be described in detail with reference to FIG. 5.

That is, the transmitter 100 may include a transforming unit to transform a time-domain signal into a frequency-domain signal, a data inserting unit 120 to insert synchronization data, and an inverse-transforming unit 130 to inverse-transform a frequency-domain signal into a time-domain signal.

The transforming unit 110 may transform an audio signal in a time-domain into a frequency-domain signal, based on a first-type transform. In particular, the transforming unit 110 may transform an audio signal in a time-domain to a frequency-domain signal based on an MCLT.

The data inserting unit 120 may insert synchronization data to the frequency-domain signal. Particularly, the data inserting unit 120 may insert synchronization data into the frequency-domain signal, by changing a phase with respect to a predetermined frequency.

The inverse-transforming unit 130 may inverse-transform the frequency-domain signal into a time-domain signal based on the first-type transform, and may transmit the time-domain signal. Particularly, the inverse-transforming unit 130 may transform the frequency-domain signal to which the synchronization data is inserted into a time-domain signal and thus, may transmit the time-domain signal to the receiver 200 through acoustic communication.

Figure 6:
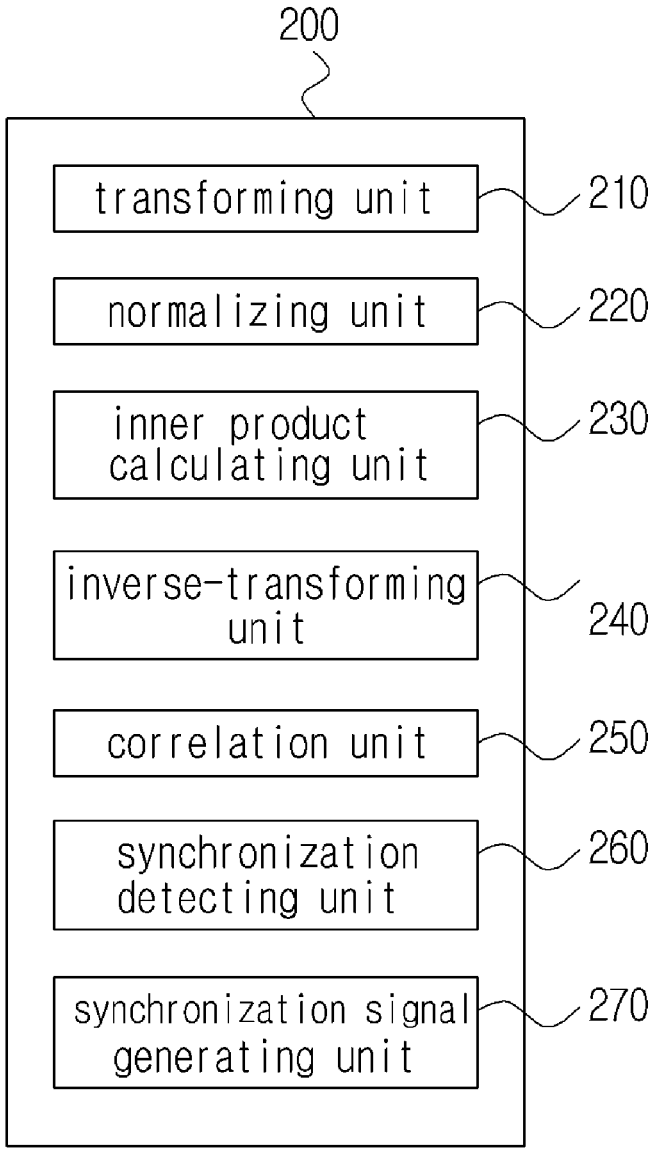
FIG. 6 is a diagram illustrating a configuration of a receiver according to an embodiment of the present invention.

Hereinafter, a configuration of the receiver 200 will be described in detail with reference to FIG. 6.

The receiver 200 may include a transforming unit 210, a normalizing unit 220, an inner product calculating unit 230, an inverse-transforming unit 240, a correlation unit 250, a synchronization location detecting unit 260, and a synchronization signal generating unit 270.

The transforming unit 210 may transform a time-domain signal received from the transmitter 100 into a frequency-domain signal. Particularly, the transforming unit 210 may receive a time-domain signal, which is formed by transforming into the frequency-domain signal based on an MCLT for insertion of synchronization data for acoustic communication and inverse-transforming based on an IMCLT. The transforming unit 210 may transform the time-domain signal into a frequency-domain signal based on an FFT.

The normalizing unit 220 may perform normalization associated with a frequency-domain signal. Particularly, the normalizing unit 220 may normalize, to a predetermined size, a size of each coefficient associated with a frequency-domain signal obtained through the FFT. In this example, the normalizing unit 220 uses only phase information of a signal and does not use size information of a signal, so that excellent performance of synchronization may be obtained. Accordingly, a size of each coefficient may be required to be normalized to a predetermined size.

The inner product calculating unit 230 may calculate an inner product of signals. Particularly, the inner product calculating unit 230 may calculate an inner product of the normalized signal and a synchronization signal previously generated by the synchronization signal generating unit 270.

The inverse-transforming unit 240 may perform inverse-transforming on a result of the inner product of the signals. Particularly, the inverse-transforming unit 240 may inverse-transform the result of the inner product of the normalized signal and the previously generated synchronization signal based on the IFFT, and may output a result.

The correlation unit 250 may generate a correlation value. Particularly, the correlation unit 250 may generate a correlation value by overlapping a signal output through the IFFT with adjacent output signal in a predetermined interval.

The synchronization point detecting unit 260 may determine a synchronization point. Particularly, the synchronization point detecting unit 260 may determine a synchronization point by determining a peak value in the correlation value.

The synchronization signal generating unit 270 may generate a synchronization signal of which a size of a coefficient is, for example, '1' in an MCLT dimension, based on the synchronization data. Here, a length of the signal generated in the MCLT dimension may be M, and a phase of the signal may be '0' or 'π' depending on the synchronization data. To improve performance, a frame to which a synchronization signal is inserted and supplementary frames, that is, a previous frame and a subsequent frame, may be utilized. In this example, the supplementary frame may be generated to have a size of '1' and to have the same phase as when insertion is performed. Also, the synchronization signal generating unit 270 may calculate a value to be used for compensation associated with an effect due to an adjacent coefficient when the transmitter 100 performs inserting of a synchronization signal, and may apply the value to a coefficient to which the synchronization data is inserted. Although the size of the coefficient generated in the MCLT dimension is limited to '1' for ease of description, the size may be variously set and each coefficient may not need to be the same. Also, the synchronization signal generating unit 270 may transform the frame to which the synchronization data is inserted and the supplementary frames into time-domain signals based on the IMCLT. In this example, a length of each frame transformed into a time-domain signal based on the IMCLT may be 2M. Further, the synchronization signal generating unit 270 may perform an operation of overlapping the frame to which the synchronization signal is inserted with the adjacent frame by a length of M, so that the length of resultant frame is 2M. The synchronization signal generating unit 270 may add '0' vector having a length of 2M to the resultant frame having a length of 2M, may transform, into a frequency-domain signal based on the FFT, and may transmit it to the inner product calculating unit 230.

As described in the foregoing, the synchronization system for acoustic communication in audible frequency range may improve a synchronization performance and may reduce an amount of calculation by calculating a correlation based on a few samples instead of each sample when a receiver of the acoustic communication performs synchronization while the acoustic communication is performed in the audible frequency range through modification of an audio signal or adding of a predetermined signal to an audio signal.

Hereinafter, a synchronization method for acoustic communication in audible frequency range will be described in detail with reference to FIGS. 7 through 10.

Figure 7:
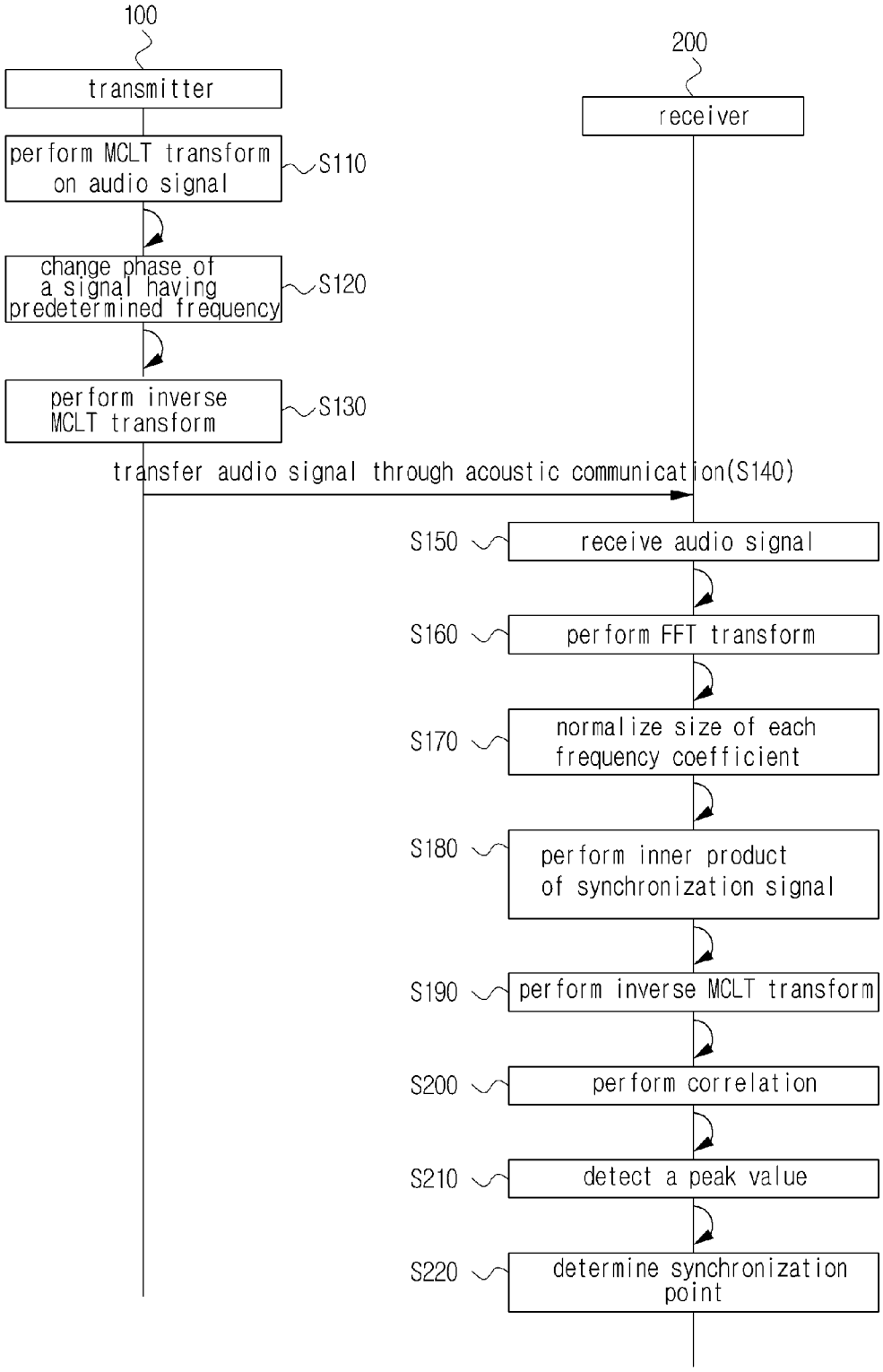
FIGS. 7 through 10 are flowcharts illustrating a synchronization method for acoustic communication in audible frequency range according to an embodiment of the present invention.

A method of operating a synchronization system for acoustic communication in audible frequency range will be described with reference to FIG. 7.

The transmitter 100 may transform an audio signal in a time-domain into a frequency-domain signal based on an MCLT, and may change a phase with respect to a predetermined frequency corresponding to synchronization data for the acoustic communication (steps S110 and S120).

Then, the transmitter 100 may inverse-transform the signal into a time-domain signal based on an IMCLT, and may transmit, to the receiver 200 through the acoustic communication, the audio signal in a form of the time-domain signal to which the synchronization data is inserted (steps S130 and S140).

The receiver 200 may receive the audio signal transmitted from the transmitter 100, and may transform the received audio signal into a frequency-domain signal based on an FFT (steps S150 and S160).

Then, the receiver 200 may normalize, to a predetermined size, a size of each coefficient associated with the frequency-domain signal obtained through the transform based on the FFT (step S170).

The receiver 200 may calculate an inner product of the normalized signal and a previously generated synchronization signal, may inverse-transform a result of the inner product, may generate a correlation value by overlapping a signal output from the inverse-transform with a previous output signal in part, and may detect a location of a peak from the correlation value (steps S180 through S210).

The receiver 200 may detect the location of the peak in a previous step and thus, may determine a synchronization location based on the detected location of the peak (step S220).

Figure 8:
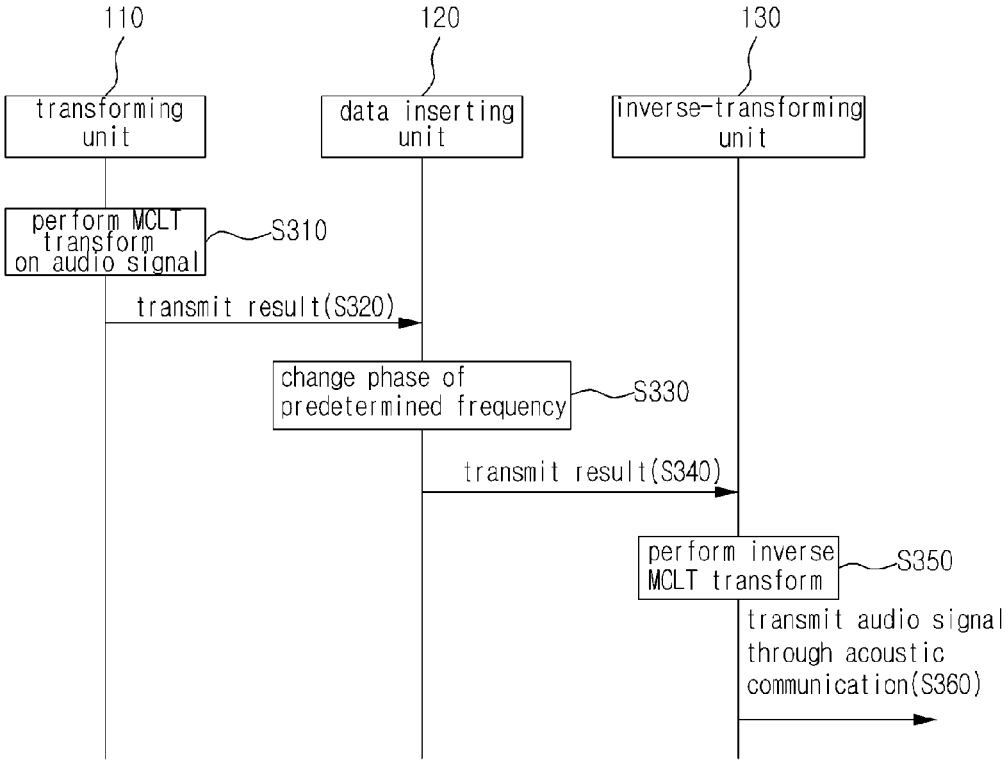

Hereinafter, a method of operating the transmitter 100 will be described in detail with reference to FIG. 8.

The transmitter 100 may transform an audio signal in a time-domain into a frequency-domain signal based on a first-type transform (steps S310 and S320). The transforming unit 110 may transform an audio signal in a time-domain to a frequency-domain signal through use of an MCLT.

The transmitter 100 may insert synchronization data into the frequency-domain signal (steps S330 and S340). The data inserting unit 120 may insert the synchronization data into the frequency-domain signal, by changing a phase with respect to a predetermined frequency. Here, according to the MCLT, a time-domain signal vector that is a real number and has a length of 2M may be received and may be transformed into a frequency-domain signal vector having a length of M. In this example, a value of the frequency-domain signal obtained as a result of the MCLT may be a complex number. Also, the vector input as an input of the MCLT may be referred to as a frame. Accordingly, data required for synchronization may be input by changing a value of the frame.

Subsequently, the transmitter 100 may inverse-transform the frequency-domain signal into a time-domain signal based on the first-type transform, and may transmit the signal (steps S350 and S360). The inverse-transforming unit 130 may transform, based on an IMCLT, the frequency-domain signal to which the synchronization data is inserted into a time-domain signal, and may transmit the signal to the receiver 200 through the acoustic communication. Here, when inverse-transform based on the IMCLT is performed on the frequency-domain signal to which the synchronization data is inserted by changing a value of the frame, a time-domain signal vector that is a real number and has a length of 2M may be generated and the time-domain signal vector may be used for the acoustic communication.

Figure 9:
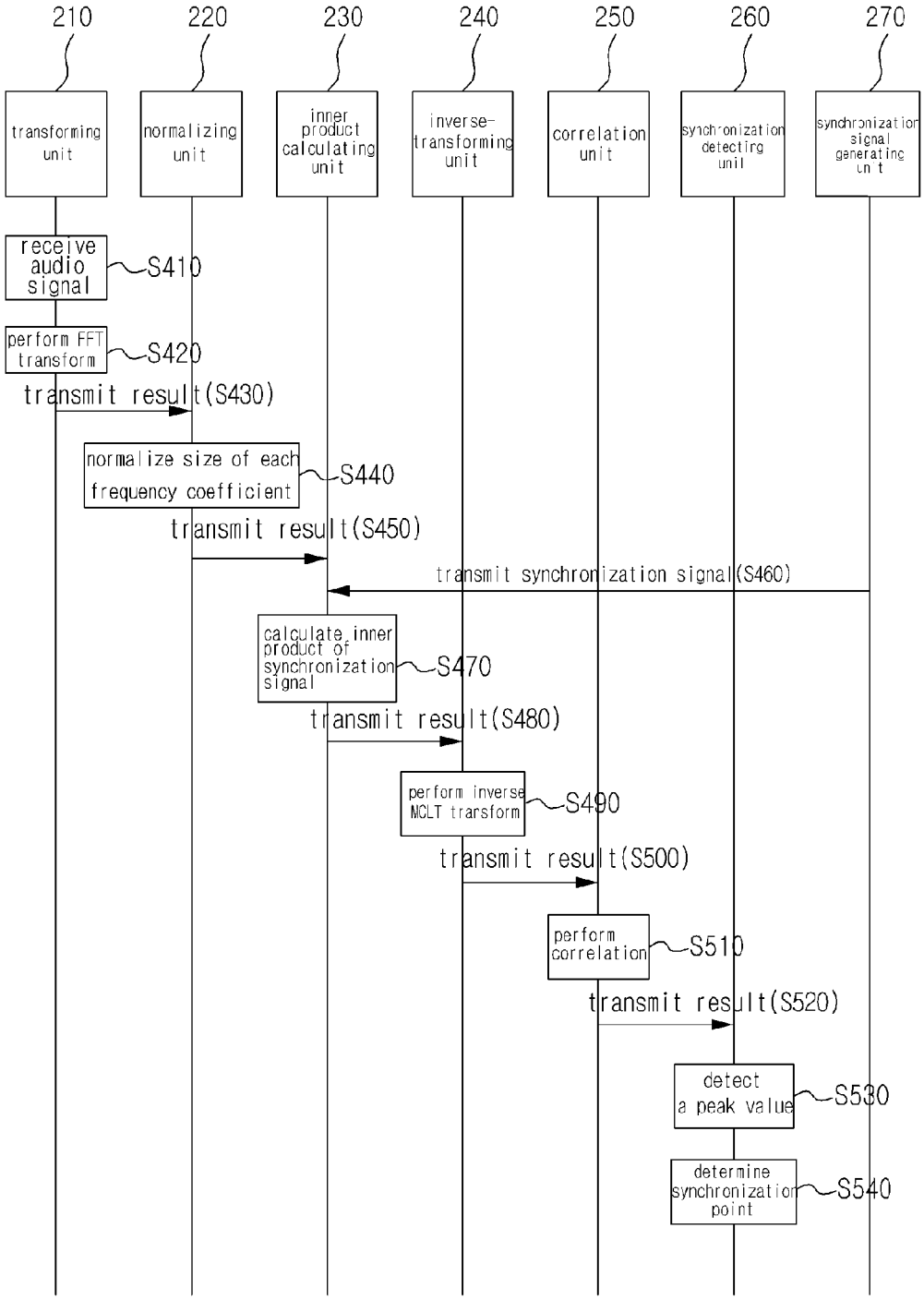

Hereinafter, a method of operating the receiver 200 will be described in detail with reference to FIG. 9.

The receiver 200 may transform a time-domain signal received from the transmitter 1200 into a frequency-domain signal (steps S410 through S430). The transforming unit 210 may receive, from the transmitter 100, a time-domain signal that is formed by transforming into the frequency-domain signal based on an MCLT for insertion of the synchronization data for the acoustic communication and then inverse-transforming based on an IMCLT, and may transform the time-domain signal into a frequency-domain signal based on an FFT.

Then, the receiver 200 may perform normalization associated with the frequency-domain signal (steps S440 and S450). The normalizing unit 220 may normalize, to a predetermined size, a size of each coefficient associated with the frequency-domain signal obtained through the transform based on the FFT. In this example, when the normalizing unit 220 uses only phase information of a signal without using size information of a signal, excellent performance of synchronization may be obtained. Accordingly, a size of each frequency coefficient may be required to be normalized to a predetermined size.

Then, the receiver 200 may calculate an inner product of signals (steps S460 and S480). The inner product calculating unit 230 may calculate an inner product of the normalized signal and a synchronization signal previously generated by the synchronization signal generating unit 270.

Next, the receiver 200 may inverse-transform a result of the inner product of the signals (steps S490 and S500). The inverse-transforming unit 240 may inverse-transform the result of the inner product of the normalized signal and the previously generated synchronization signal based on an IFFT, and may output a result.

Subsequently, the receiver 200 may generate a correlation value (steps S510 and S520). The correlation unit 250 may generate a correlation value by overlapping a signal output as a result of the IFFT with adjacent output signal in a predetermined interval.

Then, the receiver 200 may determine a synchronization location (steps S530 and S540). The synchronization location detecting unit 260 may determine a synchronization location by determining a location of a peak detected from the correlation value.

Figure 10:
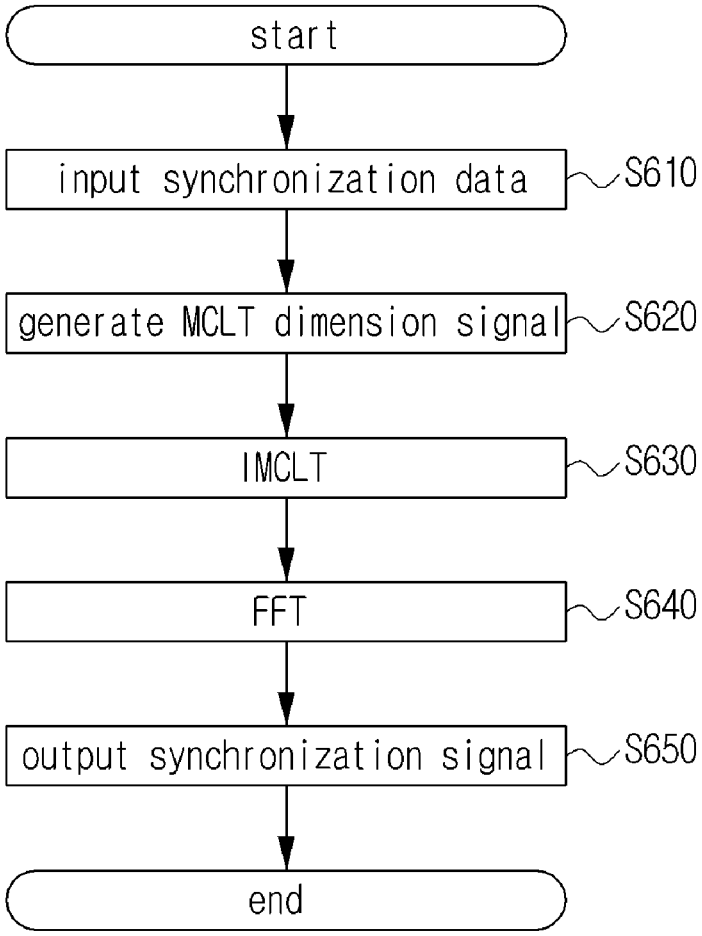

Hereinafter, operations of the synchronization signal generating unit 270 that generates a synchronization signal will be described with reference to FIG. 10 in detail.

The synchronization signal generating unit 270 may generate a synchronization signal of which a size of a coefficient is, for example, '1' in an MCLT dimension, based on provided synchronization data (steps S610 and S620). Here, a length of the signal generated in the MCLT dimension may be M and a phase of the signal may be '0' or '1' depending on the synchronization data. To improve performance, a frame to which a synchronization signal is inserted and supplementary frames, that is, a previous frame and a subsequent frame may be utilized. In this example, the supplementary frame may be generated to have a size of '1' and to have the same phase as when insertion is performed. Also, the synchronization signal generating unit 270 may calculate a value to be used for compensation associated with an effect occurring due to an adjacent coefficient in the same manner as when the transmitter 100 performs inserting of a synchronization signal, and may apply the value to a coefficient to which the synchronization data is inserted. Although the size of the coefficient generated in the MCLT dimension is limited to '1' for ease of description, the size may be variously set and each coefficient may not need to be the same.

Then, the synchronization signal generating unit 270 may transform the frame to which the synchronization data is inserted and the supplementary frames into time-domain signals based on an IMCLT (step S630). In this example, a length of each frame transformed into a time-domain signal based on the IMCLT may be 2M.

Subsequently, the synchronization signal generating unit 270 may perform an operation of overlapping the frame to which the synchronization signal is inserted with the adjacent frame by a length of M, so that the length of resultant frame is 2M. The synchronization signal generating unit 270 may add '0' vector having a length of 2M to the resultant frame having a length of 2M, may transform, into a frequency-domain signal based on the FFT, and may transmit it to the inner product calculating unit 230 (steps S640 and S650).

Figure 11:
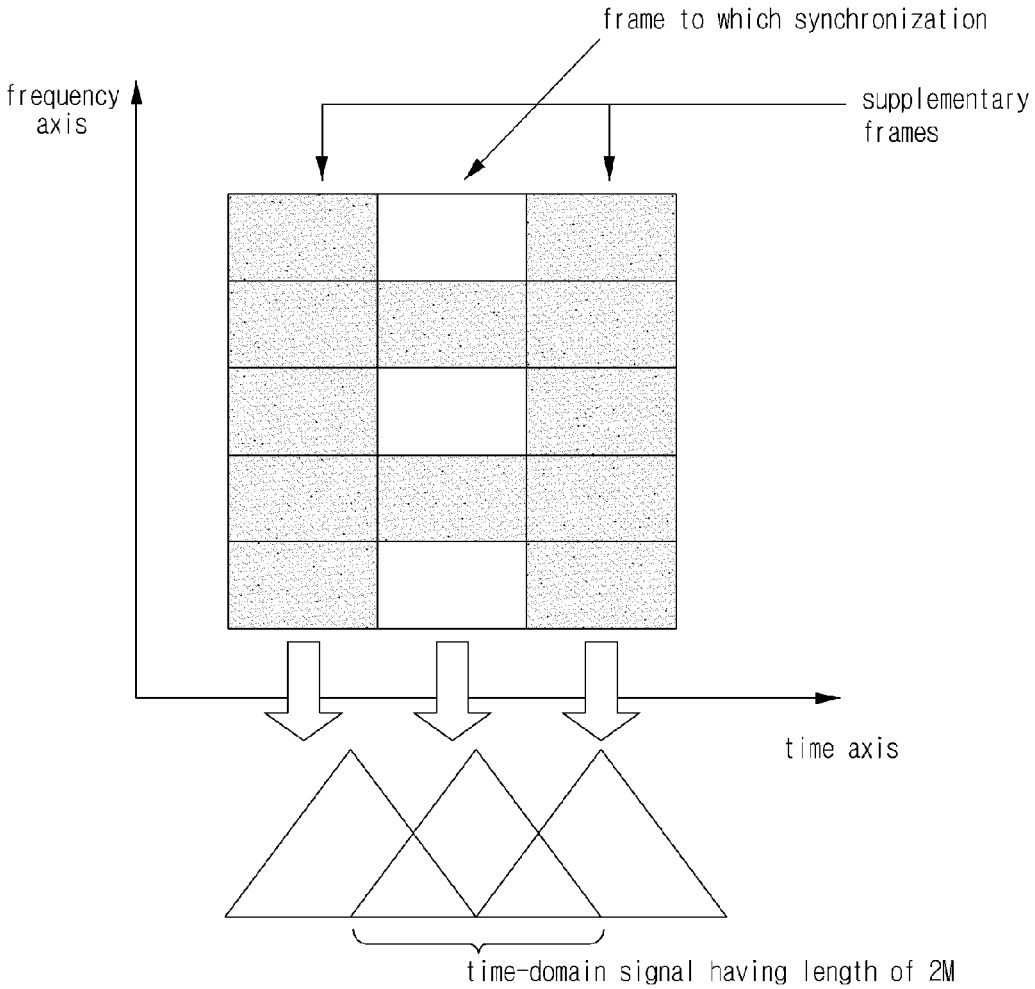
FIG. 11 is a diagram illustrating a process where a receiver generates a synchronization signal according to an embodiment of the present invention.

That is, as illustrated in FIG. 11, in a case of signal transform to a time-domain signal based on an IMCLT, a length of each frame may be 2M. When the signals transformed into time-domain signals are added by overlapping the time-domain signals by a length of M based on a frame to which a synchronization signal is inserted, a vector having a length of 4M may be obtained, and within the length of 4M, a length of 2M is utilized for the synchronization signal.

As described in the foregoing, the synchronization method for acoustic communication in audible frequency range may improve a synchronization performance and may reduce an amount of calculation by calculating a correlation based on a few samples as opposed to calculating a correlation for each sample when a receiver of the acoustic communication performs synchronization while the acoustic communication is performed in the audible frequency range through modification of an audio signal or adding of a predetermined signal to an audio signal.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

INDUSTRIAL APPLICABILITY

The present invention may prevent deterioration of a synchronization performance and may reduce an amount of calculation by calculating a correlation based on a few samples, as opposed to calculating a correlation for each sample when a receiver of the acoustic communication performs synchronization during the acoustic communication in the audible frequency range through modification of an audio signal or adding of a predetermined signal to an audio signal. Accordingly, the present invention has an industrial applicability since it has a sufficiently high probability of being available on the market and can be substantially embodied.

The invention claimed is:

1. A receiving apparatus for acoustic data communication in audible frequency range, the apparatus comprising:

a transforming unit configured to receive an audio signal, the audio signal being formed by inserting synchronization data into a frequency-domain signal transformed based on a first-type transform and being inverse-transformed, based on the first-type transform, into a time-domain signal, and to transform the audio signal into a frequency-domain signal based on a second-type transform;

a normalizing unit configured to normalize a size of coefficient of the frequency-domain signal transformed based on the second-type transform to a predetermined size;

an inner product calculating unit configured to calculate an inner product of the normalized signal and a pre-generated synchronization signal;

an inverse-transforming unit configured to inverse-transform, based on the second-type transform, a result of the inner product;

a correlation unit configured to generate a correlation value by overlapping the inverse-transformed signal with a previous inversed transformed signal in a predetermined interval; and a synchronization point detecting unit configured to determine a point of the synchronization data based on a point of a peak in the correlation value.

2. The apparatus as claimed in claim 1, wherein the first transform or the inverse-transform based on the first-type transform includes a modified complex lapped transform (MCLT), wherein the second-type transform or the inverse-transform based on the second-type transform includes a fast Fourier transform (FFT), and wherein the transforming unit is configured to transform an input signal which is consist of a frame of audio signal and a predetermined vector.

3. The apparatus as claimed in claim 2, wherein, after transforming the input signal, the transforming unit configured to use, as an input signal, a audio signal corresponding to a length of the vector.

4. The apparatus as claimed in claim 1, further comprising:

a synchronization signal generating unit configured to generate the synchronization signal.

5. The apparatus as claimed in claim 4, wherein the synchronization signal generating unit comprises:

a first processing module configured to generate the synchronization data to be a first-type signal;

a second processing module configured to inverse-transform the first-type signal into a time-domain signal, and to overlap the inverse-transformed first type signal with adjacent inversed transformed signals to the inverse-transformed first type signal in a predetermined interval; and a third processing module configured to generate an input signal by adding a predetermined vector to a result obtained from the second processing module, to transform the input signal into a frequency-domain signal based on the second-type transform, and to provide the transformed input signal to the inner product calculating unit.

6. A synchronization method for acoustic data communication in audible frequency range, the method comprising:

receiving an audio signal, the audio signal being formed by inserting synchronization data into a frequency-domain signal transformed based on a first-type transform and being inverse-transformed, based on the first-type transform, into a time-domain signal, and transforming the audio signal into a frequency-domain signal based on a second-type transform;

normalizing, to a predetermined size, a size of coefficient of the frequency-domain signal transformed based on the second-type transform;

calculating an inner product of the normalized signal and a pre-generated synchronization signal;

inverse-transforming, based on the second-type transform, a result of the inner product;

generating a correlation value by overlapping the inverse-transformed signal with a previous inversed transformed signal in a predetermined interval; and determining a point of the synchronization data based on a peak value in the correlation value.

7. The method as claimed in claim 6, further comprising: generating a synchronization signal.

8. The method as claimed in claim 7, wherein generating of the synchronization signal comprises:

a first processing to generate the synchronization data to be a first-type signal;

a second processing to inverse-transform the first-type signal into a time-domain signal, and to overlap the inverse-transformed first type signal with adjacent inversed transformed signals to the inverse-transformed first type signal in a predetermined interval; and a third processing to generate an input signal by adding a predetermined vector to a result obtained from the second processing, to transform the input signal into a frequency-domain signal based on the second-type transform, and to provide the transformed input signal to the inner product calculating unit.

* * * * *